US010152885B2

(12) United States Patent
Shimodaira et al.

(10) Patent No.: US 10,152,885 B2
(45) Date of Patent: Dec. 11, 2018

(54) VEHICLE GUIDANCE DEVICE AND VEHICLE GUIDANCE METHOD

(71) Applicant: NISSAN MOTOR CO., LTD., Kanagawa (JP)

(72) Inventors: Seiji Shimodaira, Kanagawa (JP); Hiroya Fujimoto, Kanagawa (JP); Junichi Kasai, Kanagawa (JP); Yasuhisa Kishi, Kanagawa (JP); Satoshi Kawai, Kanagawa (JP)

(73) Assignee: NISSAN MOTOR CO., LTD., Kanagawa (JP)

( * ) Notice: Subject to any disclaimer, the term of this patent is extended or adjusted under 35 U.S.C. 154(b) by 0 days.

(21) Appl. No.: 15/568,343

(22) PCT Filed: Apr. 21, 2015

(86) PCT No.: PCT/JP2015/062121
§ 371 (c)(1),
(2) Date: Oct. 20, 2017

(87) PCT Pub. No.: WO2016/170602
PCT Pub. Date: Oct. 27, 2016

(65) Prior Publication Data

US 2018/0158330 A1 Jun. 7, 2018

(51) Int. Cl.
*G08G 1/00* (2006.01)
*G08G 1/09* (2006.01)
(Continued)

(52) U.S. Cl.
CPC ..... *G08G 1/0967* (2013.01); *G08G 1/0112* (2013.01); *G08G 1/0133* (2013.01);
(Continued)

(58) Field of Classification Search
None
See application file for complete search history.

(56) References Cited

U.S. PATENT DOCUMENTS

2015/0066350 A1* 3/2015 Iwata ..... G01C 21/3469 701/400
2018/0056996 A1* 3/2018 Lee ..... B60T 8/17557

FOREIGN PATENT DOCUMENTS

JP 2006-309735 A 11/2006
JP 2011-237329 A 11/2011

OTHER PUBLICATIONS

International Search Report issued in corresponding application No. PCT/JP2015/062121 dated Jul. 21, 2015 (1 page).
(Continued)

*Primary Examiner* — Thomas G Black
*Assistant Examiner* — Demetra R Smith-Stewart
(74) *Attorney, Agent, or Firm* — Osha Liang LLP

(57) ABSTRACT

A vehicle guidance device has a stopping vehicle detector configured to detect stopping vehicles failing to pass through a traffic light while a light is green, the traffic light being installed beside a plurality of lanes extending in a same direction, an information acquisition unit configured to acquire a starting characteristic of each detected vehicle, and a simultaneous passage line calculator configured to calculate a simultaneous passage line including a first line and a second line based on the acquired starting characteristics, when a vehicle having a lower starting characteristic than a reference starting characteristic is included in the vehicles stopping on a first lane included in the plurality of lanes, and when a vehicle having a higher starting characteristic than starting characteristics of the vehicles on the first lane is included in the vehicles stopping on a second lane included in the plurality of lanes.

8 Claims, 14 Drawing Sheets

(51) Int. Cl.
*G08G 1/0967* (2006.01)
*G08G 1/01* (2006.01)

(52) U.S. Cl.
CPC ..... *G08G 1/0145* (2013.01); *G08G 1/09* (2013.01); *G08G 1/096775* (2013.01)

(56) References Cited

OTHER PUBLICATIONS

Written Opinion of the International Searching Authority issued in corresponding application No. PCT/JP2015/062121 dated Jul. 21, 2015 (3 pages).
International Preliminary Report on Patentability issued in Application No. PCT/JP2015/062121, dated Nov. 2, 2017 (11 pages).

* cited by examiner (a)

(b)

VEHICLE GUIDANCE DEVICE AND VEHICLE GUIDANCE METHOD

BACKGROUND

Technical Field

The present invention relates to a vehicle guidance device and a vehicle guidance method.

Related Art

There is a conventional technique for guiding vehicles on lanes extending in the same direction, which is designed to seek congestion levels of the respective lanes and to guide a vehicle to a lane at a low congestion level.

Patent Literature 1: Japanese Patent Application Publication No. 2011-237329

SUMMARY OF INVENTION

However, if another vehicle with slow starting acceleration such as a large-size vehicle stops in front of the guided vehicle, for example, then the guided vehicle is influenced by the vehicle with the slow starting acceleration and is forced to start slowly as well.

Hence, the guided vehicle may fail to pass through a traffic light while the light is green and may stop again as a consequence. In other words, there may be a case where it is difficult to increase the number of vehicles that pass through a traffic light even by use of the technique for guiding a vehicle to a lane at a low congestion level.

One or more embodiments of the present invention provides a vehicle guidance device and a vehicle guidance method, which are capable of increasing the number of vehicles passing through a traffic light installed beside multiple lanes extending in the same direction while the light is green.

A vehicle guidance device according to one or more embodiments of the present invention acquires starting characteristics of stopping vehicles failing to pass through a traffic light while a light is green, the traffic light being installed beside multiple lanes extending in the same direction. The vehicle guidance device calculates a simultaneous passage line including a first line and a second line. The first line indicates a rear end of a vehicle on the tail on a first lane when a vehicle having a starting characteristic lower than a reference starting characteristic is included in the first lane and when a vehicle having a starting characteristic higher than starting characteristics of the vehicles on the first lane is included in a second lane. The second line indicates a rear end at a stop position of a vehicle on the second lane predicted to pass through the traffic light simultaneously with the vehicle on the tail on the first lane. The vehicle guidance device guides a vehicle following the corresponding stopping vehicle to ahead of the simultaneous passage line.

DETAILED DESCRIPTION

Embodiments of the present invention will be described in detail with reference to the drawings. In the description, the same constituents are denoted by the same reference signs and duplicate explanations thereof will be omitted. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
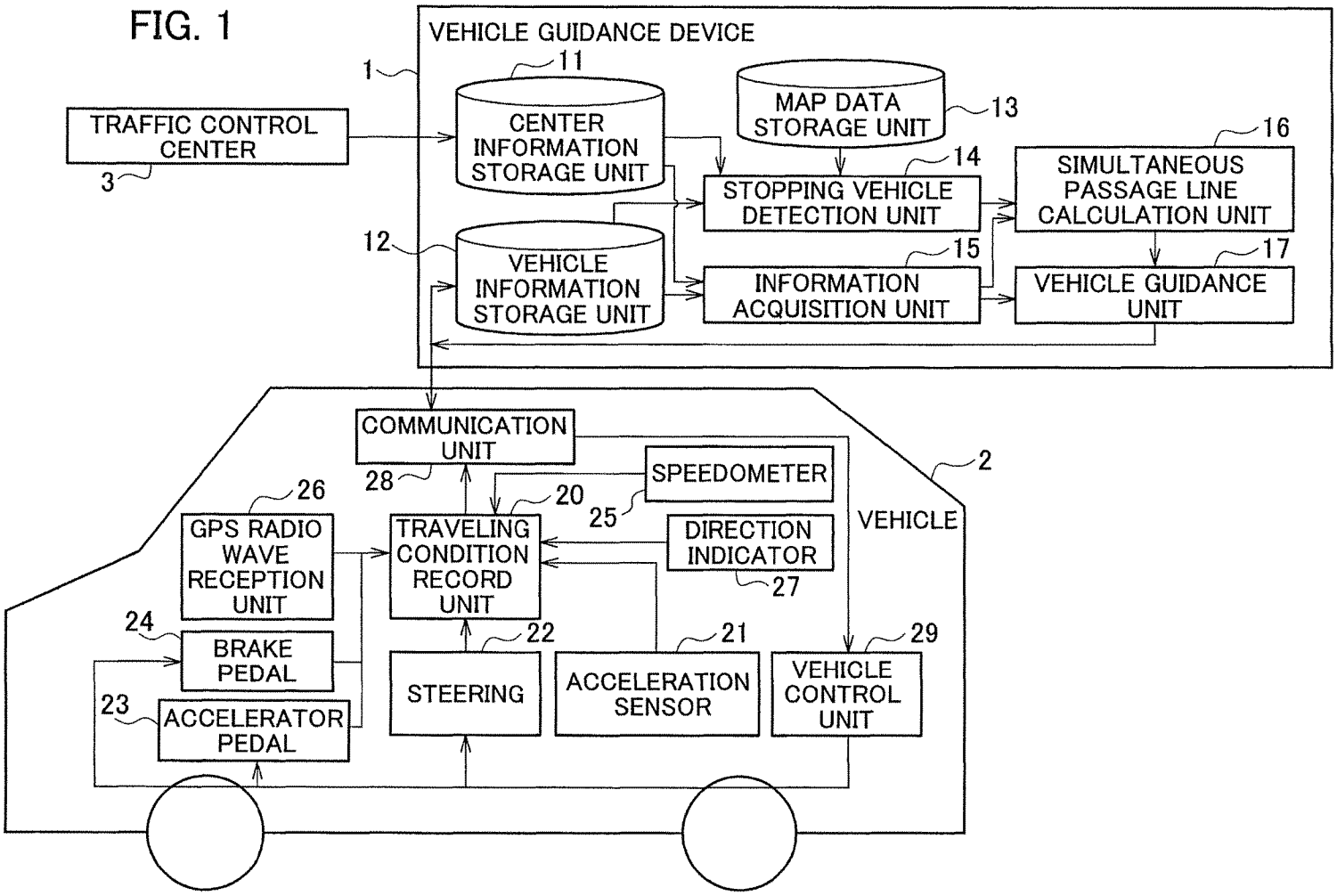
FIG. 1 is a diagram showing an example of a utility form of a vehicle guidance device according to one or more embodiments of the present invention.

An example of a utility form of a vehicle guidance device according to one or more embodiments of the present invention will be described with reference to FIG. 1.

A vehicle guidance device 1 is a device configured to guide a vehicle 2, and is capable of communicating with the vehicle 2. The vehicle 2 in FIG. 1 is illustrated as a representative for multiple vehicles. Moreover, the vehicle guidance device 1 is also capable of communicating with a server device in a traffic control center 3.

A traveling condition record unit 20 of the vehicle 2 is a block which includes a CPU, a ROM, a RAM, an interface circuit, and the like.

The traveling condition record unit 20 stores an acceleration rate of the vehicle detected with an acceleration sensor 21 attached to a gravity center position of the vehicle 2, a steering angle detected with a sensor in steering 22, an accelerator stroke angle detected with an sensor in an accelerator pedal 23, a brake stroke angle detected with a sensor in a brake pedal 24, and the like as driving histories, and then calculates and stores a starting characteristic of the vehicle 2 based on the driving histories.

Meanwhile, the traveling condition record unit 20 acquires a current speed from a speedometer 25 of the vehicle 2 and stores the current speed therein. Moreover, the traveling condition record unit 20 calculates and stores a current position of the vehicle 2 by using a radio wave that a GPS radio wave reception unit 26 receives from a GPS satellite.

In the meantime, based on a stop position of the vehicle 2 at an intersection and a stop position of another vehicle stopping in front of the vehicle 2, the traveling condition record unit 20 calculates and stores an inter-vehicle distance regarding the vehicle 2.

Meanwhile, the traveling condition record unit 20 acquires direction indicator information indicating a state of a direction indicator 27 from a sensor provided in the direction indicator 27, and stores the direction indicator information therein.

A communication unit 28 acquires the acceleration rate, the steering angle, the accelerator stroke angle, the brake stroke angle, the starting characteristic, the current speed, the current position, the inter-vehicle distance, and the direction indicator information from the traveling condition record unit 20, and sends the vehicle guidance device 1 these pieces of information as vehicle information.

In the meantime, the communication unit 28 controls a vehicle control unit 29 by a control signal received from the vehicle guidance device 1, for example. Thus, the vehicle control unit 29 controls the position of the vehicle 2 by controlling the steering 22, the accelerator pedal 23, the brake pedal 24, and the like.

The vehicle guidance device 1 includes a center information storage unit 11 which stores center information received from the server device in the traffic control center 3, a vehicle information storage unit 12 which stores the vehicle information received from the vehicle 2, and a map data storage unit 13 which stores map data of a region where the vehicle 2 travels. The vehicle guidance device 1 includes a stopping vehicle detection unit 14 which detects stopping vehicles that fail to pass through a traffic light installed beside a road where the vehicle 2 travels while the light is green, and an information acquisition unit 15 which acquires a starting characteristic of each detected vehicle from the vehicle information storage unit 12.

The vehicle guidance device 1 includes: a simultaneous passage line calculation unit 16 which calculates a simultaneous passage line based on the acquired starting characteristic, the simultaneous passage line serving as a target for guiding a following vehicle; and a vehicle guidance unit 17 which guides the following vehicle to ahead of the simultaneous passage line. The vehicle guidance device 1 carries out a vehicle guidance method.

The map data include positions of roads, positions of traffic lights, and legal speed limits of the roads. The center information includes, for example, a length of time each traffic light holds on green, a length of time each traffic light holds on red, current weather information, information on a traffic jam period of each of the roads, and so forth.

Next, the simultaneous passage line will be explained in concrete terms by citing an example.

Figure 2:
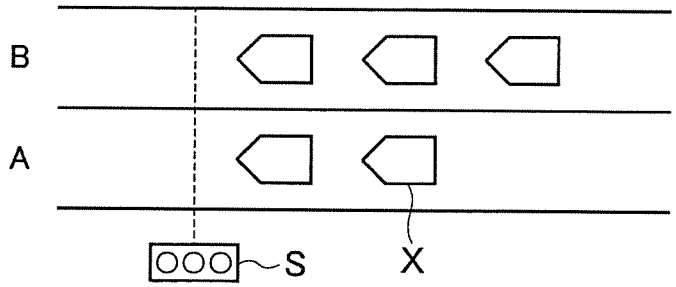
FIG. 2(*a*) is a diagram showing an example of lines of stopping vehicles which fail to pass through a traffic light S while its light is green, and FIG. 2(*b*) is a diagram showing a state where vehicles X and Y pass through the traffic light S.
Figure 2:
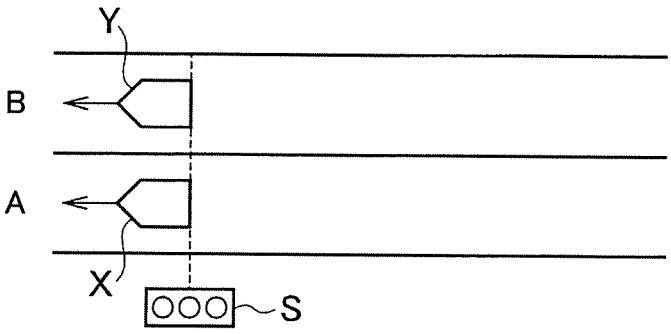

As shown in FIG. 2(*a*), a traffic light S is installed beside a road including lanes A and B that extend in the same direction. A vehicle X having a slower starting characteristic (hereinafter referred to as a low starting characteristic) in starting acceleration than a starting characteristic serving as a reference (hereinafter referred to as a reference starting characteristic) is included among vehicles stopping on the lane A. The vehicle X is also a vehicle on the tail on the lane A. Vehicles stopping on the lane B include no vehicles having the low starting characteristic.

Here, as shown in FIG. 2(*b*), a situation where the vehicle X on the tail on the lane A that includes a vehicle having the low starting characteristic and a vehicle Y having the reference starting characteristic on the lane B that includes no vehicles having the low starting characteristic start at the same time and pass through the traffic light S at the same time will be considered. That is to say, the vehicles X and Y travel for the same period of time (hereinafter referred to as time T) and then pass through the traffic light S.

At this time, the vehicle Y is assumed to accelerate in accordance with the reference starting characteristic while the vehicle X is assumed to accelerate in accordance with the low starting characteristic. Note that a lane such as the lane A which includes the vehicle having the low starting characteristic will be referred to as a first lane while a lane such as the lane B which does not include any vehicle having the low starting characteristic will be referred to as a second lane.

In other words, a second line is a rear end at a stop position of the vehicle on the second lane, which is predicted to pass through the traffic light simultaneously with the vehicle on the tail on the first lane.

Figure 3:
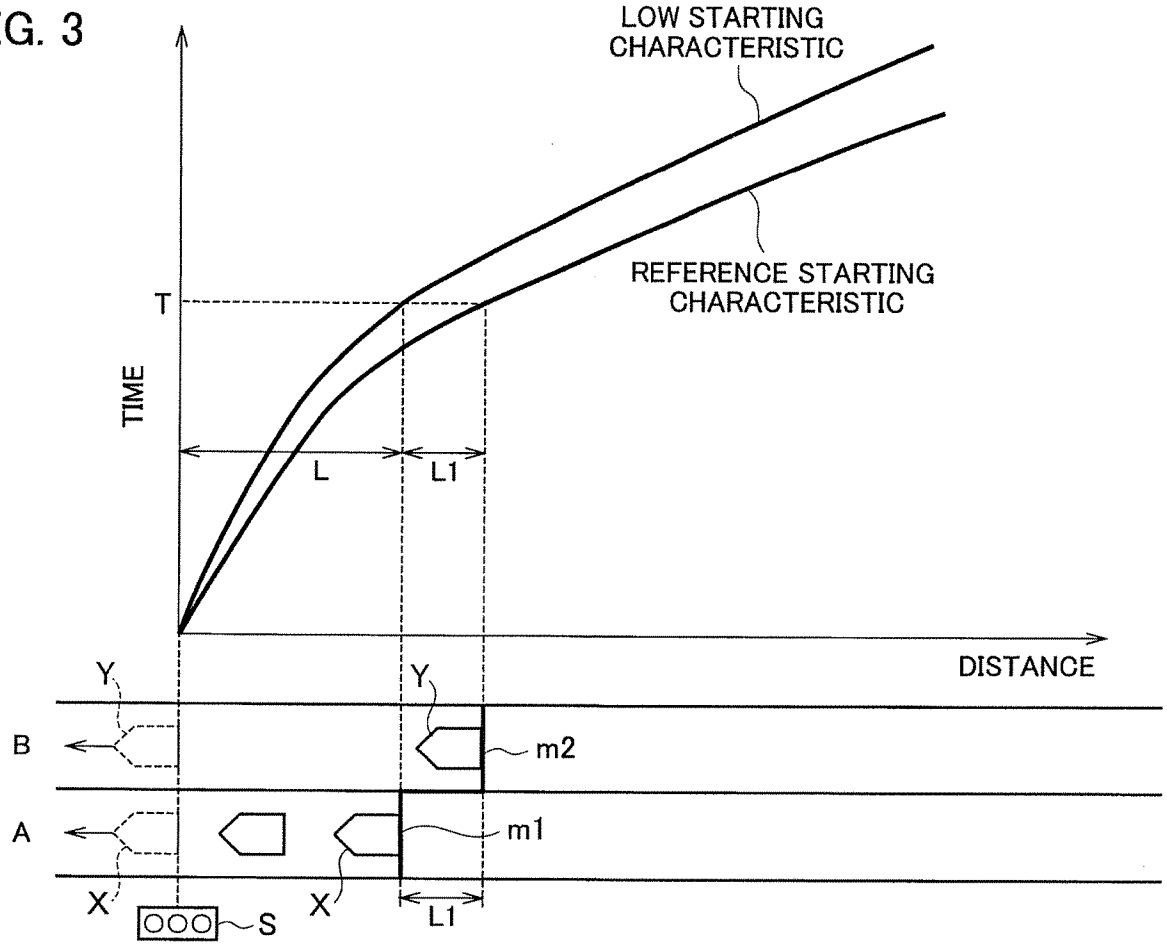
FIG. 3 is a diagram for explaining a simultaneous passage line.

The horizontal axis of a graph shown in FIG. 3 indicates a distance between a stop position of a vehicle and the traffic light S, while the vertical axis thereof indicates time required for traveling the distance. The longer the distance is, the more time is required for traveling the distance.

As shown in FIG. 3, the vehicle X having the low starting characteristic travels L [m] in the time T. The vehicle X indicated with a solid line represents a stop position of the vehicle X, while the vehicle X indicated with a dashed line represents a state after passing through the traffic light S.

On the other hand, the vehicle Y having the reference starting characteristic travels L+L1 [m] in the time T. The vehicle Y indicated with a solid line represents a stop position of the vehicle Y, while the vehicle Y indicated with a dashed line represents a state after passing through the traffic light S.

That is to say, the distance between the position at the start (the stopping position) of the vehicle X and the traffic light S is equal to L [m] and the distance between the position at the start (the stopping position) of the vehicle Y and the traffic light S is equal to L+L1 [m].

In one or more embodiments of the present invention, a rear end position of the vehicle X shown in FIG. 3 is referred to as a first line m1, a rear end position of the vehicle Y is referred to as a second line m2, and the first line m1 and the second line m2 are collectively referred to as a simultaneous passage line. For the sake of convenience, the simultaneous passage line is indicated with a heavy polygonal line that links the first line m1 to the second line m2.

Figure 4:
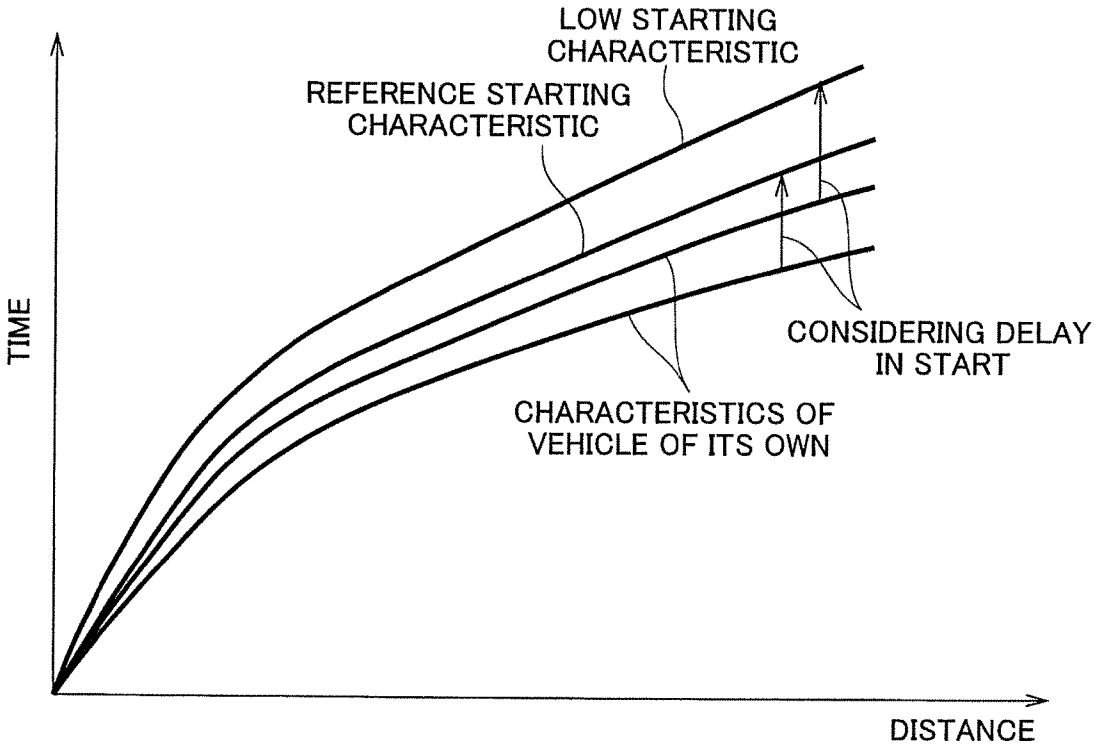
FIG. 4 is a diagram showing a reference starting characteristic and a low starting characteristic of a vehicle of its own as well as a reference starting characteristic and a low starting characteristic thereof in consideration of a delay in start.

Here, when multiple vehicles stop on the lane A, the vehicle on the tail starts after the vehicle in front thereof has started. Accordingly, the reference starting characteristic and the low starting characteristic become worse (slower) than the starting characteristic of the corresponding vehicle of its own. According to one or more embodiments of the present invention, starting characteristics are acquired while considering a delay in start as shown in FIG. 4.

Meanwhile, as with the delay in start, the starting characteristics deteriorate in a bad weather, for example. Accordingly, according to one or more embodiments of the present invention, starting characteristics are acquired after undergoing the deterioration in such a weather.

Similarly, the starting characteristics deteriorate during a period crowded with vehicles, for example. Accordingly, according to one or more embodiments of the present invention, the starting characteristics are acquired after undergoing the deterioration in such a traffic jam period.

Figure 5:
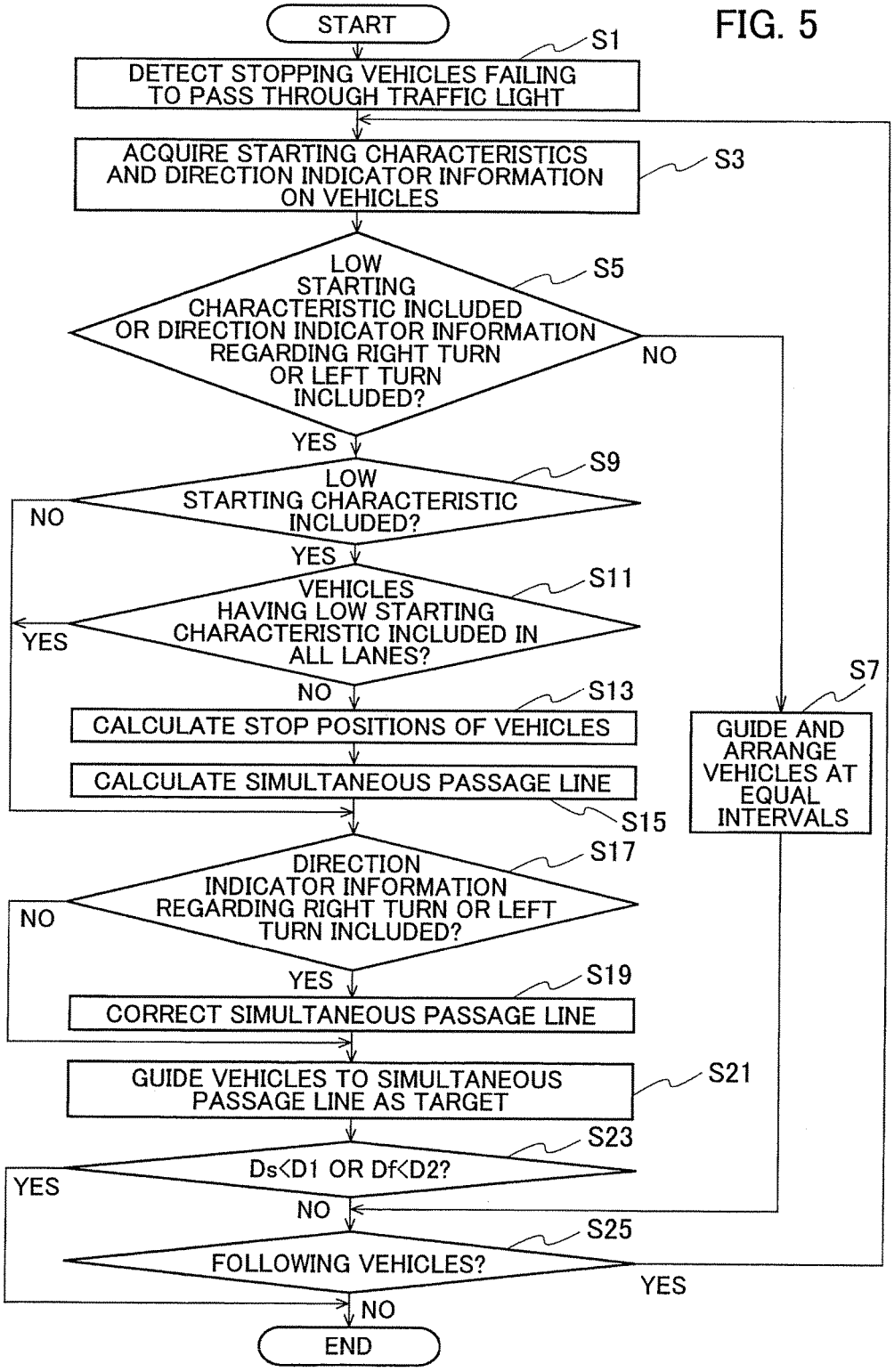
FIG. 5 is a flowchart showing an operational flow of a vehicle guidance device 1.

Next, an operational flow of the vehicle guidance device 1 will be described with reference to FIG. 5. Processing in the flowchart in FIG. 5 is repeatedly executed every predetermined period such as 10 milliseconds.

S1: From the map data in the map data storage unit 13, the stopping vehicle detection unit 14 acquires a position of a road provided with two or more lanes on each side and with a traffic light on green, a position of the traffic light, and a legal speed limit of the road. The stopping vehicle detection unit 14 also acquires current positions of vehicles traveling on the road from the vehicle information storage unit 12.

Moreover, the stopping vehicle detection unit 14 acquires remaining time in a green light state from the center information in the center information storage unit 11. The stopping vehicle detection unit 14 detects stopping vehicles, which fail to pass through the traffic light while the light is green, based on the legal speed limit of the road, the position of the traffic light, the current positions of the vehicles, and the remaining time.

For example, when the remaining time is 30 [seconds] and the legal speed limit is 60 [km/h], vehicles located far by a distance (a determination distance) of 500 [m] (=60×1000/3600×30) or more to the traffic light are supposed to stop at the traffic light. In this way, the applicable vehicles are detected.

Here, each stopping vehicle may also be detected by using the current speed and a current acceleration rate of the vehicle as well. For example, if the remaining time becomes shorter than a predetermined period, that is to say, if the determination distance becomes shorter than a predetermined distance, then the stopping vehicle may be detected based on: the position of the traffic light; the current position, the current speed, and the current acceleration rate of the vehicle; and the remaining time without using the legal speed limit.

S3: Next, the information acquisition unit 15 acquires the starting characteristics as well as the direction indicator information on the vehicles detected in step S1 from the vehicle information storage unit 12. For example, the information acquisition unit 15 acquires the starting characteristics included in the vehicle information stored in the vehicle information storage unit 12.

The information acquisition unit 15 may acquire the current weather information and the information on the traffic jam period of the road from the center information in the center information storage unit 11, thus acquiring a starting characteristic suitable for at least one of the weather and the period. For example, as supplemented in the description with reference to FIG. 4, a starting characteristic is lowered in the case of a bad weather or during the traffic jam period. Alternatively, such a starting characteristic is stored in advance and used as appropriate.

S5: Next, the simultaneous passage line calculation unit 16 determines whether or not one of the following conditions is satisfied, namely, (condition 1) that the low starting characteristic is included in the acquired starting characteristics, and (condition 2) that direction indicator information indicating a state of taking a right turn or a left turn is included in the acquired direction indicator information. If none of the two conditions is satisfied (S5: NO), the processing proceeds to step S7. When at least one of the conditions is satisfied (S5: YES), the processing proceeds to step S9.

Note that the determination of the (condition 2) as to whether or not the direction indicator information indicating the state of taking a right turn or a left turn is included is equivalent to determination as to whether or not the vehicle takes a right turn or a left turn, or travels straight. This determination can be made without using the direction indicator information. For example, a driving history of a driver may be included in the vehicle information to be acquired. Then, based on the driving history, the right turn or the left turn may be assumed at such a location where the driver often made the right turn or the left turn in the past.

S7: The vehicle guidance unit 17 guides and arranges the vehicles detected in step S1 at equal intervals, and then the processing proceeds to step S25. In step S7, the vehicle guidance unit 17 transmits control signals to vehicles which need to change current positions, for example, and the vehicles receiving the control signals automatically change the current positions and are thus arranged at equal intervals.

Here, a map screen installed in each vehicle may indicate a position after the change based on the control signal, and the driver thus urged may move the vehicle to the position after the change, for example. Alternatively, the movement may be guided by voices and the like. Still further, the vehicle may be urged to move by suggestion for the movement instead of the direct control or instructions as mentioned above. Here, even if the vehicle does not change the position in spite of being controlled or suggested, the fact remains that the vehicle has been guided. The same applies to similar vehicle guidance to be described later.

S9: The simultaneous passage line calculation unit 16 determines whether or not the low starting characteristic is included in the starting characteristics acquired in step S3. The processing proceeds to step S11 when the low starting characteristic is included in the acquired starting characteristics (S9: YES), or proceeds to step S17 when the low starting characteristic is not included therein (S9: NO).

S11: The simultaneous passage line calculation unit 16 acquires the current position of each vehicle having the low starting characteristic from the vehicle information storage unit 12. Based on the current position, the simultaneous passage line calculation unit 16 determines whether or not the vehicles having the low starting characteristic are included in all the lanes. The processing proceeds to step S17 when the vehicles having the low starting characteristic are included in all the lanes (S11: YES), or proceeds to step S13 when no vehicles having the low starting characteristic are included in at least one of the lanes (S11: NO).

S13: The simultaneous passage line calculation unit 16 calculates the stop position of each vehicle detected in step S1. The stop position is calculated based on the current speed, the current position, the inter-vehicle distance at the time of stoppage, and the current acceleration rate in the vehicle information, for example. Meanwhile, communication among the vehicles may be enabled and the number of vehicles traveling ahead of a certain vehicle may be acquired by the inter-vehicle communication and used for the calculation. Further, a vehicle length of each vehicle may be acquired and used for the calculation.

S15: Next, the simultaneous passage line calculation unit 16 calculates the simultaneous passage line (the first line m1 and the second line m2) based on the stop positions calculated in step S13 and on the low starting characteristic, and for each of combinations of the first lane including the vehicle having the low starting characteristic and the adjacent second lane not including any vehicle having the low starting characteristic. Then, the processing proceeds to step S17.

S17: The simultaneous passage line calculation unit 16 determines whether or not the direction indicator information indicating the state of taking a right turn or a left turn is included in the direction indicator information acquired in step S3. The processing proceeds to step S19 when the direction indicator information indicating the state of taking a right turn or a left turn is included in the acquired direction indicator information (S17: YES), or proceeds to step S21 if the information is not included therein (S17: NO).

Here, as with the step S5, the determination may be made based on the driving history as to whether or not the vehicle is about to take a right turn or a left turn. Then, the processing may proceed to step S19 when the vehicle is about to take a right turn or a left turn, or may proceed to step S21 if the vehicle is about to travel straight.

S19: The simultaneous passage line calculation unit 16 corrects the simultaneous passage line, and then the processing proceeds to step S21.

In step S19, when one or more vehicles (right-turn vehicles or left-turn vehicles) corresponding to the direction indicator information indicating the state of taking a right turn or a left turn are included in the first lane, for example, the simultaneous passage line calculation unit 16 moves the second line m2 backward in response to the number of the right-turn vehicles or the left-turn vehicles. Meanwhile, when one or more right-turn vehicles or left-turn vehicles are included in the second lane, for example, the simultaneous passage line calculation unit 16 moves the second line m2 forward in response to the number of the right-turn vehicles or the left-turn vehicles.

S21: The vehicle guidance unit 17 guides a vehicle to the simultaneous passage line as a target, and then the processing proceeds to step S23. For example, the vehicle guidance unit 17 guides a following vehicle, which travels from behind the simultaneous passage line, to ahead of the simultaneous passage line.

S23: The information acquisition unit 15 acquires the length of time the corresponding traffic light holds on green from the center information in the center information storage unit 11. The vehicle guidance unit 17 determines whether or not any one of two conditions (conditions 1 and 2) is satisfied.

The condition 1 is that a distance (referred to as Ds) which the vehicle starting with the low starting characteristic travels in the length of time the traffic light holds on green is shorter than a distance (referred to as D1) between the traffic light and the first line m1. The condition 2 is that a distance (referred to as Df) which the vehicle starting with the reference starting characteristic travels in the length of time the traffic light holds on green is shorter than a distance (referred to as D2) between the traffic light and the second line m2.

The control in the flowchart of FIG. 5 is terminated when at least one of the conditions is satisfied (S23: YES). The processing proceeds to step S25 if none of the conditions is satisfied (S23: NO).

S25: The vehicle guidance unit 17 determines whether or not there is a vehicle which follows each vehicle detected in step S1. The control in the flowchart of FIG. 5 is terminated when there are no following vehicles (S25: NO). The processing returns to step S3 when there is a following vehicle (S25: YES).

When the processing returns from step S25 to step S3, each following vehicle detected in step S25 is considered as the vehicle detected in step S1, namely, the vehicle stopping short of the traffic light. Moreover, in the subsequent step S3, the information acquisition unit 15 acquires the starting characteristic and the direction indicator information on each of the following vehicles detected in step S25 from the vehicle information storage unit 12.

Next, the guidance of vehicles using the simultaneous passage line will be described by using a specific example.

Figure 6:
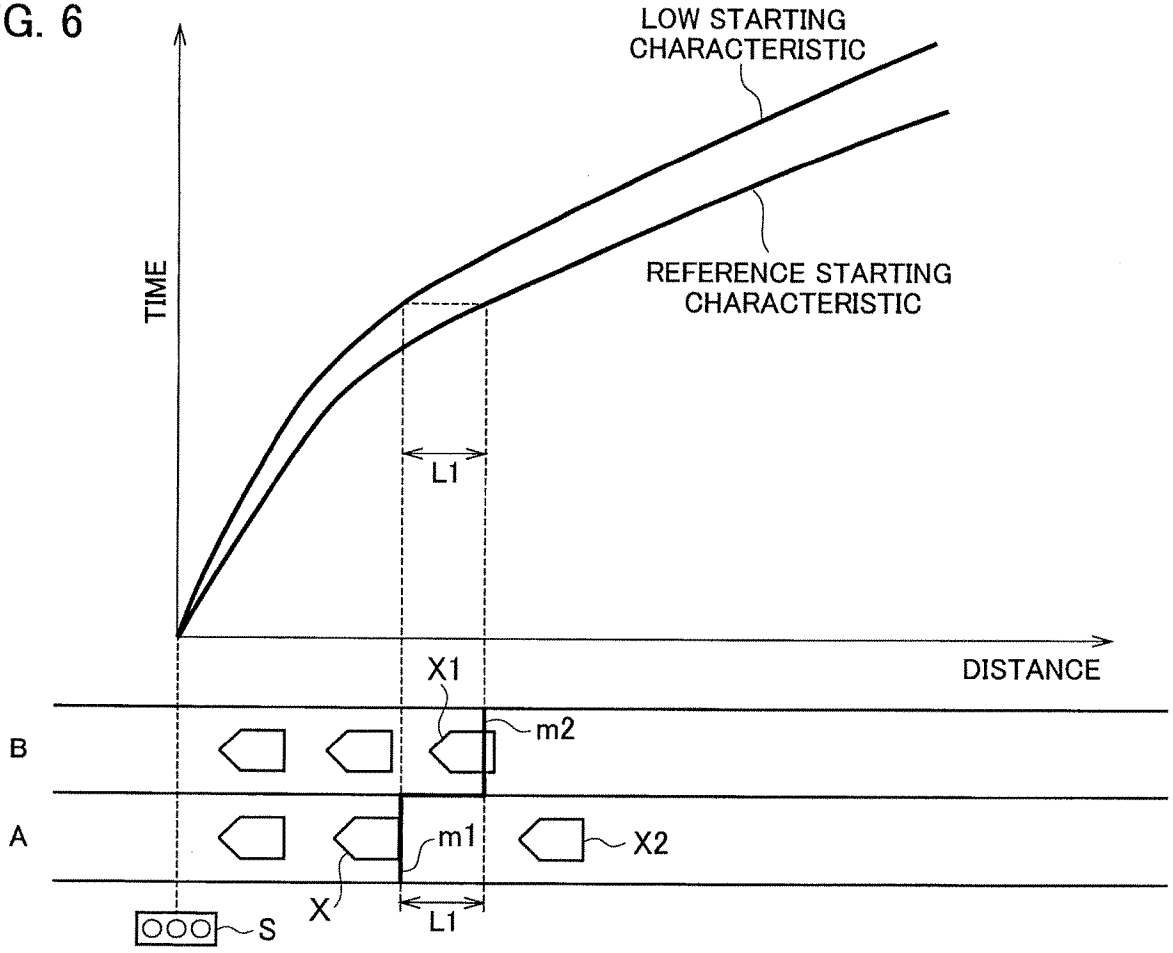
FIG. 6 is a diagram showing a state in which a following vehicle X2 travels toward one of the lines of vehicles in FIG. 2(*a*).

As shown in FIG. 6, a following vehicle X2 travels toward a line of the vehicles in FIG. 2(*a*).

The position of the first line m1 is at the rear end of the vehicle X while the position of the second line m2 is located L1 [m] behind the first line m1, as has been described with reference to FIG. 3.

Figure 7:
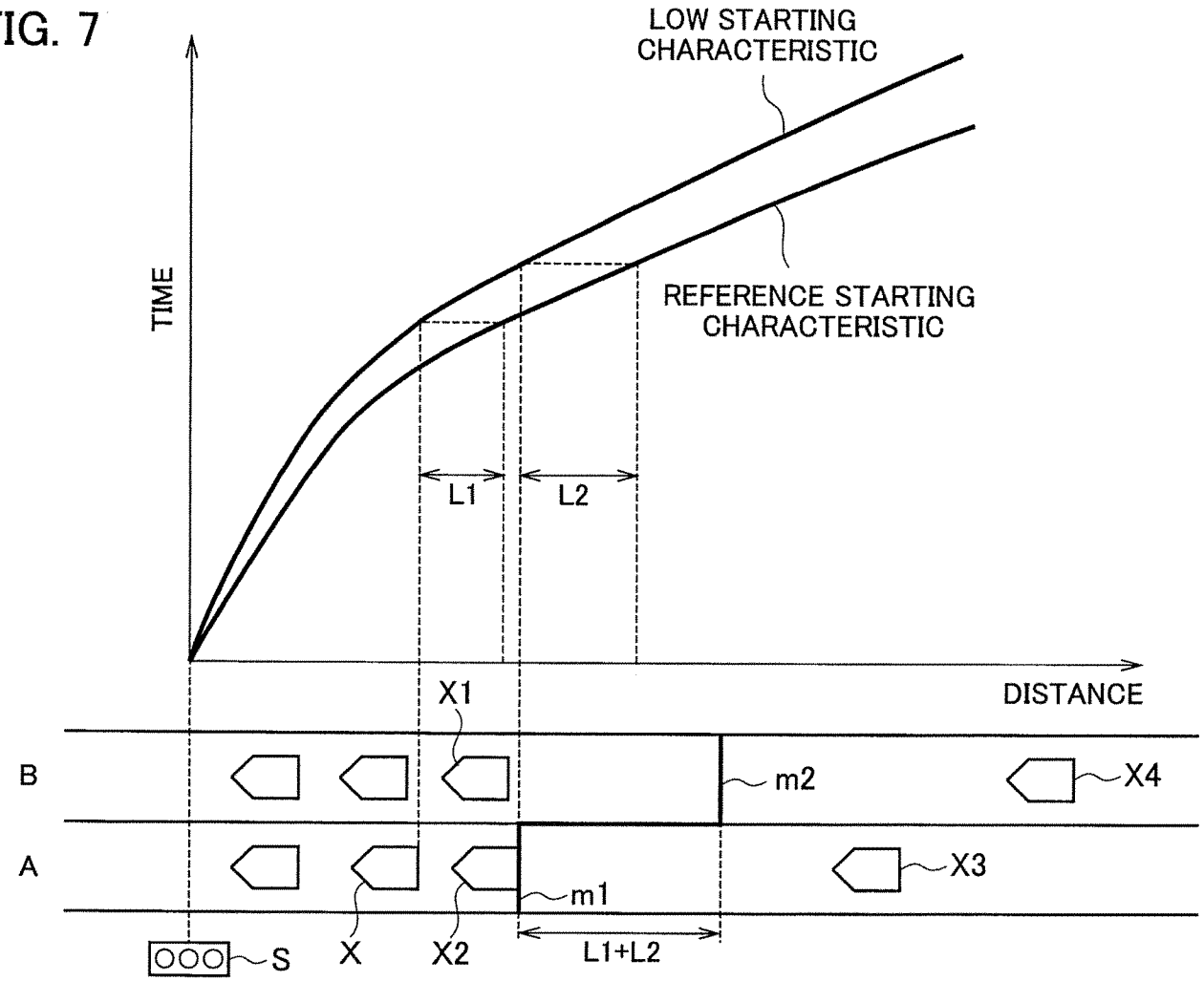
FIG. 7 is a diagram showing a state in which a new simultaneous passage line is calculated after guiding the vehicle X2 in FIG. 6, and following vehicles X3 and X4 come along.

In FIG. 6, a vehicle X1 crosses the second line m2 and there is no space that allows entry of the vehicle ahead of the second line m2. Accordingly, the vehicle guidance device 1 guides the vehicle X2 to the lane A with a shorter line of the vehicles as shown in FIG. 7.

The vehicle guidance device 1 calculates a new simultaneous passage line in terms of a line of the vehicles including the vehicle X2.

As the vehicle X2 stops behind the vehicle X, the vehicle X2 is bound to start with the low starting characteristic in spite of having the reference starting characteristic. The vehicle guidance device 1 considers that the vehicle X2 has the low starting characteristic, and calculates a distance L2 [m] corresponding to the vehicle X2 by using the same method as that for L1. The position of such a new first line m1 is at the rear end of the vehicle X2 while the position of a new second line m2 is located L1+L2 [m] behind the first line m1.

Subsequently, following vehicles X3 and X4 come along.

Figure 8:
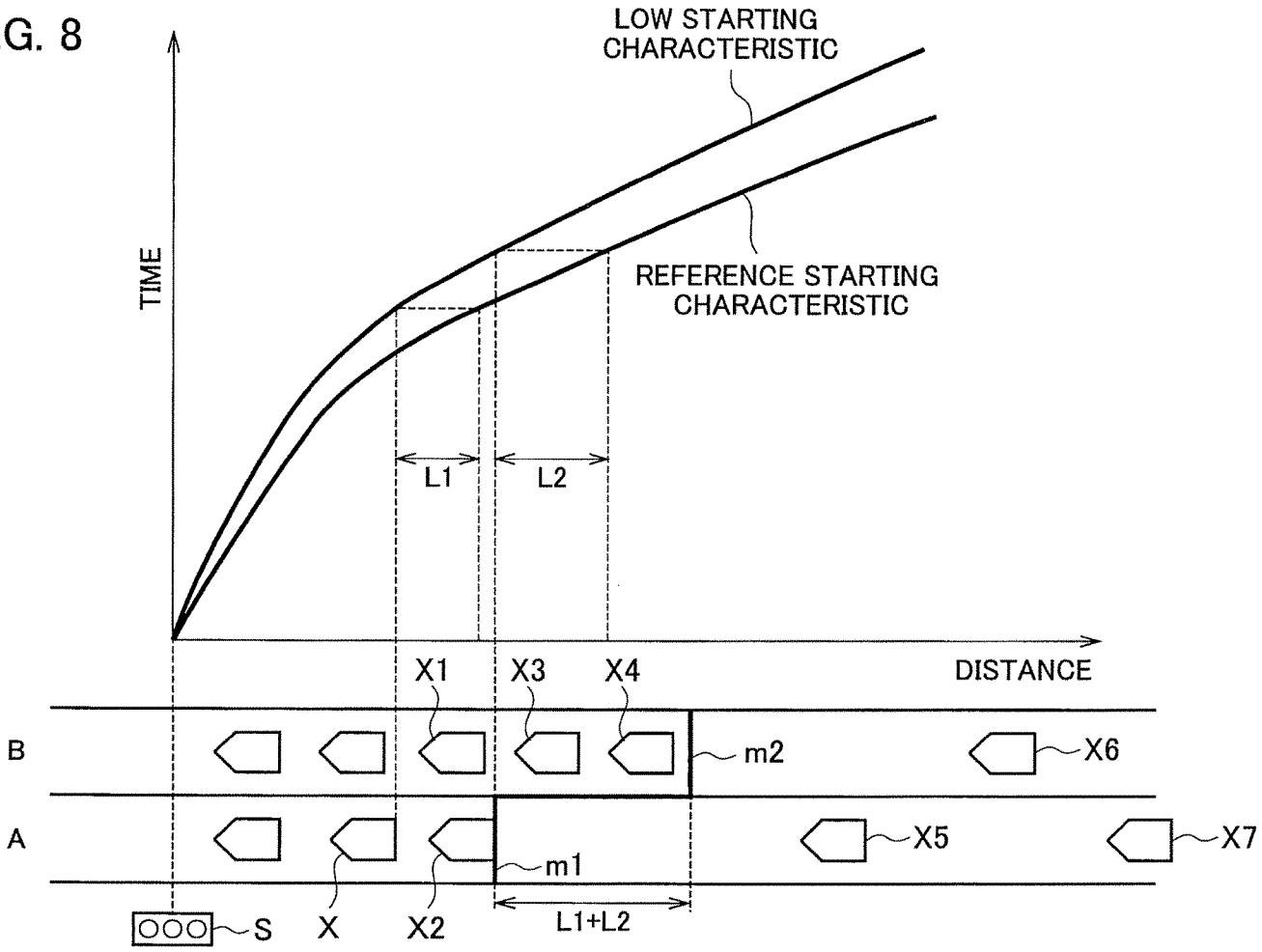
FIG. 8 is a diagram showing a state in which following vehicles X5, X6, and X7 come along after guiding the vehicles X3 and X4 in FIG. 7.

There is a space that allows entry of the vehicles ahead of the second line m2. Accordingly, the vehicle guidance device 1 guides the vehicles X3 and X4 to the space ahead of the second line m2 as shown in FIG. 8.

As a consequence, the vehicles X3 and X4 can pass through the traffic light S simultaneously with or earlier than the vehicle X2 on the tail.

Here, the information acquisition unit 15 may acquire vehicle type information on the vehicle from that vehicle, while the simultaneous passage line calculation unit 16 may calculate the simultaneous passage line based on the vehicle type information, and the vehicle guidance unit 17 may guide the vehicle to ahead of a simultaneous passage line calculated based on the vehicle type information.

For example, if the length of the vehicle comes out of the vehicle type information, it is possible to calculate the simultaneous passage line more accurately. Even when a position of a driver seat in the vehicle on the tail on the first lane is defined as the current position, the position of the second line varies depending on the length of the vehicle. It is possible to surely increase the number of vehicles that pass through the traffic light S while the light is green by obtaining the length of the vehicle from the vehicle type information and calculating the second line depending on the length.

Thereafter, following vehicles X5, X6, and X7 come along. Here, since the space ahead of the second line m2 has been depleted by the vehicles X3 and X4, the vehicle guidance device 1 guides the vehicle X5 to the lane A with a shorter line of the vehicles as shown in FIG. 9.

The vehicle guidance device 1 calculates a new simultaneous passage line in terms of a line of the vehicles including the vehicle X5.

The vehicle guidance device 1 considers that the vehicle X5 has the low starting characteristic, and calculates a distance L3 [m] corresponding to the vehicle X5 by using the same method as that for L1 and L2. The position of a new first line m1 is at the rear end of the vehicle X5 while the position of a new second line m2 is located L1+L2+L3 [m] behind the first line m1.

Figure 9:
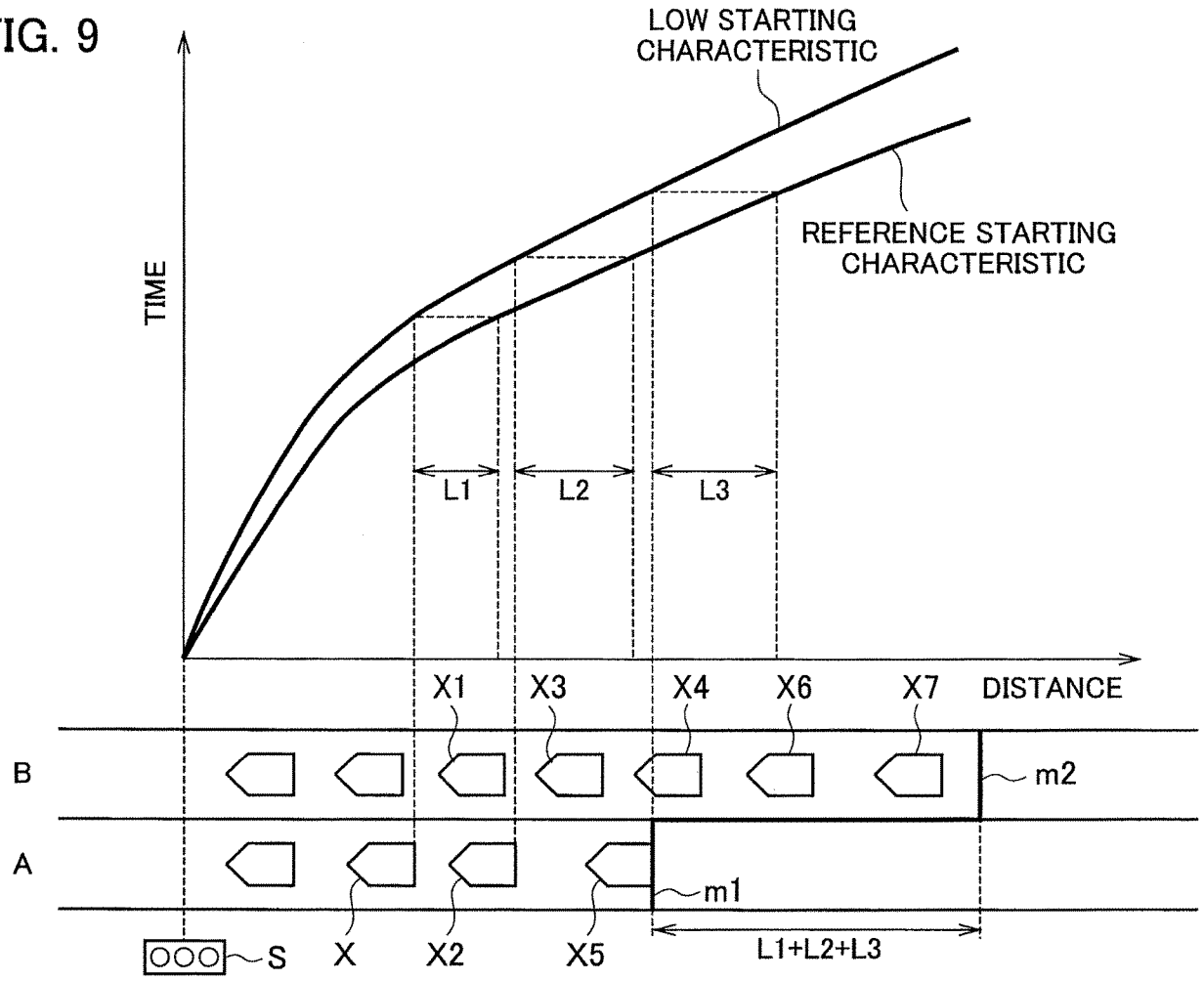
FIG. 9 is a diagram showing a state in which following vehicles X6 and X7 are guided by calculating a new simultaneous passage line after guiding the vehicle X5 in FIG. 8.

Here, regarding the vehicles other than the vehicle X2 in FIG. 6, if the vehicles X2, X3, X4, and X5 come along and the vehicle X5 becomes the vehicle on the tail on the lane A, then the simultaneous passage line (m1 and m2) in FIG. 9 may be calculated in the first place without calculating the simultaneous passage lines (m1 and m2) shown in FIGS. 7 and 8. In this way, it is unnecessary to calculate the earlier simultaneous passage lines and is thus possible to reduce a calculation load.

That is to say, when the vehicle on the tail of the multiple vehicles following the stopping vehicle becomes the vehicle on the tail on the first lane, the simultaneous passage line calculation unit 16 determines the rear end of that vehicle as the first line and calculates the second line based on the first line. In this way, it is possible to reduce the load to calculate the simultaneous passage lines.

There is a space that allows entry of the vehicles ahead of the new second line m2. Accordingly, the vehicle guidance device 1 guides the vehicles X6 and X7 to the space ahead of the second line m2.

As described above, according to one or more embodiments of the present invention, the vehicle guidance device 1 detects the stopping vehicles, which fail to pass through the traffic light while the light is green, and acquires the starting characteristics of the respective detected vehicles. Then, based on the starting characteristics, the vehicle guidance device 1 calculates the simultaneous passage line when the vehicle having the starting characteristic lower than the reference starting characteristic is included in the vehicles stopping on the first lane (A) and when no vehicles having the low starting characteristic are included in the vehicles stopping on the second lane (B).

The simultaneous passage line includes the first line (m1) indicating the rear end of the vehicle (X) on the tail on the first lane (A), and the second line (m2) indicating the rear end at the stop position of the vehicle (Y) on the second lane (B), which is predicted to pass through the traffic light simultaneously with the vehicle on the tail on the first lane. The vehicle guidance device 1 guides the following vehicles to ahead of the simultaneous passage line.

Thus, the guided vehicles X3 and X4, for example, can pass through the traffic light S simultaneously with or earlier than the vehicle X2 on the tail. Meanwhile, the guided vehicles X6 and X7 can pass through the traffic light S simultaneously with or earlier than the vehicle X5 on the tail. As a consequence, it is possible to increase the number of vehicles that pass through the traffic light S while the light is green, and to enhance a traffic flow rate.

Meanwhile, the information acquisition unit 15 acquires the starting characteristic suitable for at least one of the weather and the period at the time of calculation of the simultaneous passage line, while the simultaneous passage line calculation unit 16 calculates the simultaneous passage line based on the starting characteristic, and the vehicle guidance unit 17 guides the vehicle to ahead of the simultaneous passage line. Accordingly, in the case of a bad weather or during the traffic jam period when the starting characteristic is different from that in a good weather or during a period without a traffic jam, for example, it is still possible to increase the number of vehicles passing through the traffic light S while the light is green.

Next, a description will be given of a case where a vehicle taking a right turn or a vehicle taking a left turn is included in a line of vehicles.

Figure 10:
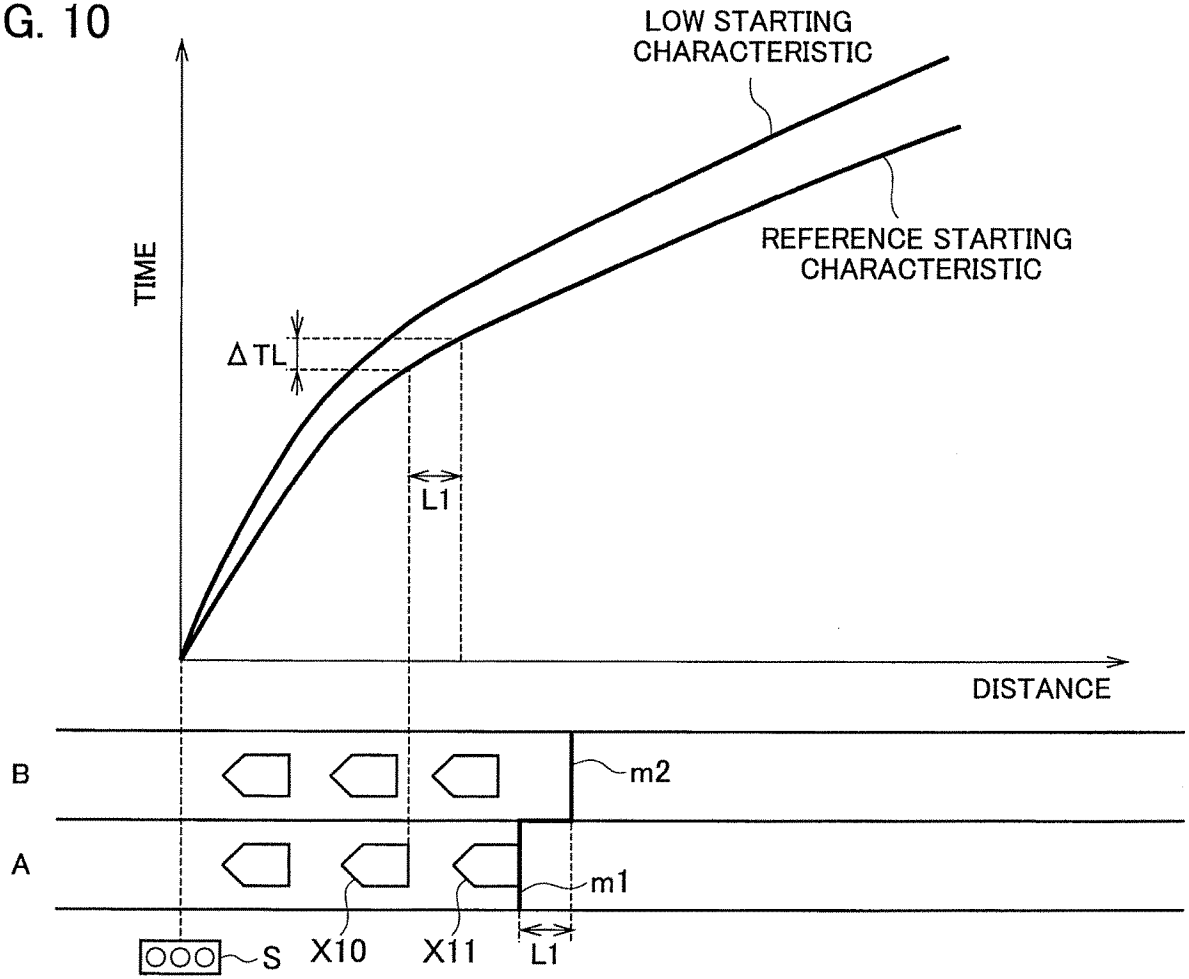
FIG. 10 is a diagram showing lines of vehicles in which no vehicles having a low starting characteristic are included in lanes A and B while a vehicle taking a left turn is included in the lane A, and showing an example of a calculated simultaneous passage line.

In FIG. 10, there are no vehicles having the low starting characteristic, and a vehicle X10 on the lane A is about to take a left turn at the position of the traffic light S. Time required for the vehicle to take a left turn will be defined as ΔTL [seconds]. The vehicle X10 passes through the traffic light S ΔTL [seconds] later than the case of traveling straight. Meanwhile, a vehicle X11 right behind the vehicle X10 is influenced by the vehicle X10 even when the vehicle X11 travels straight, and therefore passes through the traffic light S ΔTL [seconds] later.

The position of the first line m1 is at the rear end of the vehicle X11. Assuming that a distance which a vehicle having the reference starting characteristic travels in a period of ΔTL [seconds] at the position of the traffic light S is L1 [m], then the position of the second line m2 is located L1 [m] behind the first line m1.

When there is a vehicle (the vehicle X10 in the case of FIG. 10) taking a right turn or a left turn on the first lane (the lane A in FIG. 10) including the vehicle having the low starting characteristic, the stop position of the vehicle Y in FIG. 3 needs to be located farther from the traffic light S than that in the case where there are no vehicles taking a right turn or a left turn on the first lane. Accordingly, the second line m2 is moved backward by L1 [m] in FIG. 10.

Figure 11:
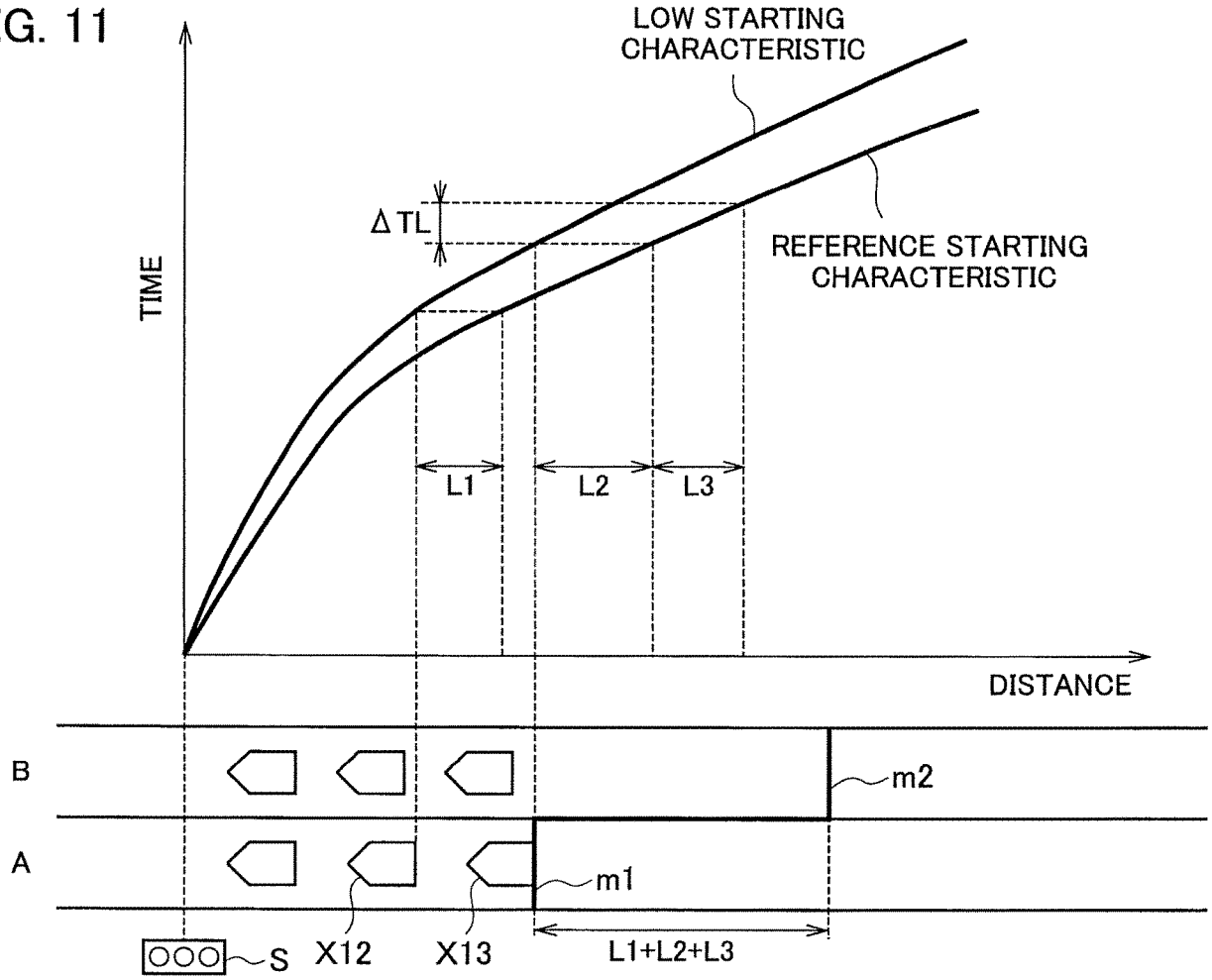
FIG. 11 is a diagram showing lines of vehicles in which a vehicle having a low starting characteristic and a vehicle taking a left turn are included in the lane A, and showing an example of a calculated simultaneous passage line.

In FIG. 11, a vehicle X12 on the lane A is a vehicle having the low starting characteristic while a vehicle X13 right behind is about to take a left turn at the position of the traffic light S. Other vehicles are vehicles having the reference starting characteristic and are about to travel straight through the traffic light S.

A distance L1 [m] is a difference between a distance from the vehicle X12 having the low starting characteristic to the traffic light S and a distance that a vehicle having the reference starting characteristic travels in a period required for the vehicle X12 to pass through the traffic light S.

A distance L2 [m] is a difference between a distance from the vehicle X13, which is regarded as having the low starting characteristic due to the influence of the vehicle X12 in front thereof, to the traffic light S and a distance that the vehicle having the reference starting characteristic travels in a period required for the vehicle X13 to pass through the traffic light S.

A distance L3 [m] is a distance that the vehicle having the reference starting characteristic travels at the position of the traffic light S in ΔTL [seconds].

The position of the first line m1 is at the rear end of the vehicle X13, and the position of the second line m2 is located L1+L2+L3 [m] behind the first line m1.

When there is a vehicle (a vehicle X13 in the case of FIG. 11) taking a right turn or a left turn on the first lane (the lane A in FIG. 11) including the vehicle having the low starting characteristic, the stop position of the vehicle Y in FIG. 3 needs to be located farther from the traffic light S than that in the case where there are no vehicles taking a right turn or a left turn on the first lane. Accordingly, the second line m2 is moved backward by L3 [m] in FIG. 11.

If there is no space for a vehicle ahead of the second line m2 before movement, a following vehicle is guided to right behind the vehicle X13, for example. For this reason, the guided vehicle cannot pass through the traffic light S simultaneously with the vehicle X13.

On the other hand, when there is provided a space for a vehicle ahead of the second line m2 after the movement, the following vehicle is guided to the space. Accordingly, the vehicle can pass through the traffic light S simultaneously with or earlier than the vehicle X13.

Thus, it is possible to increase the number of vehicles that pass through the traffic light S more than that in the case of not moving the second line m2.

Here, according to one or more embodiments of the present invention, when a vehicle driven by a driver having a low-speed driving characteristic is included in the lane A, the second line is moved backward as with the case where the vehicle taking a right turn or a left turn is included in the lane A. For example, a driving characteristic of a driver who has more chances of traveling at a low speed is defined as the low-speed driving characteristic, while a driving characteristic of a driver who has less chances of traveling at a low speed is defined as a high-speed driving characteristic.

For example, the driving characteristic of each driver is included in the vehicle information. The information acquisition unit 15 acquires the driving characteristic of the driver of each stopping vehicle from the vehicle information, while the simultaneous passage line calculation unit 16 determines whether the driving characteristic corresponding to each vehicle stopping on the first lane is the low-speed driving characteristic or the high-speed driving characteristic, and moves the second line backward when the driving characteristic is determined as the low-speed driving characteristic.

In this way, as with the case where the vehicle taking a right turn or a left turn is included in the lane A, it is possible to increase the number of vehicles that pass through the traffic light S more than that in the case of not moving the second line m2.

Figure 12:
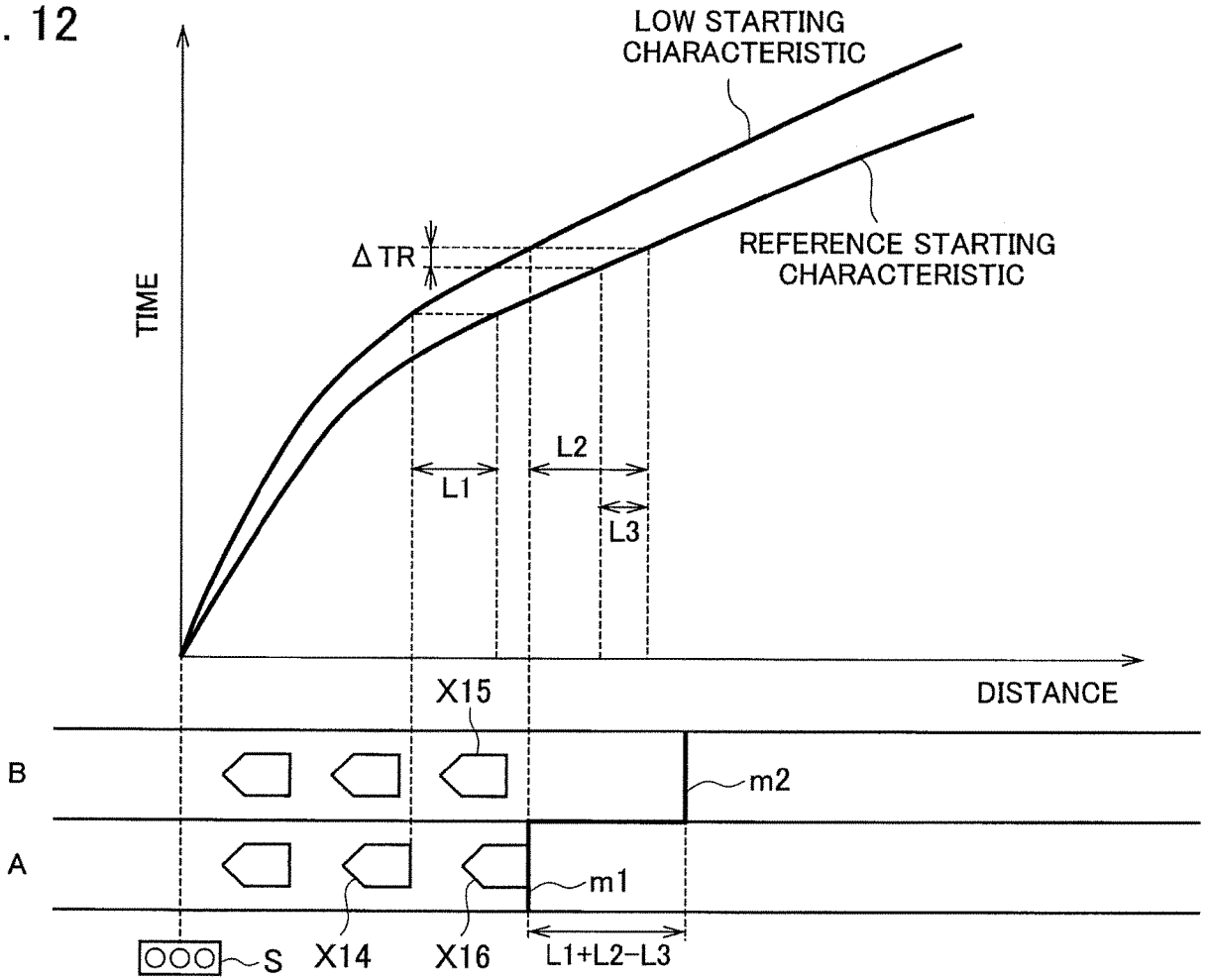
FIG. 12 is a diagram showing lines of vehicles in which a vehicle having a low starting characteristic is included in the lane A and a vehicle taking a right turn is included in the lane B, and showing an example of a calculated simultaneous passage line.

In FIG. 12, a vehicle X14 on the lane A is a vehicle having the low starting characteristic while a vehicle X15 on the lane B is about to take a right turn at the position of the traffic light S. Other vehicles are vehicles having the reference starting characteristic and are about to travel straight through the traffic light S.

A distance L1 [m] is a difference between a distance from the vehicle X14 having the low starting characteristic to the traffic light S and a distance that a vehicle having the reference starting characteristic travels in a period required for the vehicle X14 to pass through the traffic light S.

A distance L2 [m] is a difference between a distance from the vehicle X16, which is regarded as having the low starting characteristic due to the influence of the vehicle X14 in front thereof, to the traffic light S and a distance that the vehicle having the reference starting characteristic travels in a period required for the vehicle X16 to pass through the traffic light S.

A distance L3 [m] is a distance that the vehicle having the reference starting characteristic travels in ΔTR [seconds] required for taking a right turn.

The position of the first line m1 is at the rear end of the vehicle X16, and the position of the second line m2 is located L1+L2−L3 [m] behind the first line m1.

When there is a vehicle (the vehicle X15 in the case of FIG. 12) taking a right turn or a left turn on the second lane (the lane B in FIG. 12) including no vehicles having the low starting characteristic, the stop position of the vehicle Y in FIG. 3 needs to be located closer to the traffic light S than that in the case where there are no vehicles taking a right turn or a left turn on the second lane. Accordingly, the second line m2 is moved forward by L3 [m] in FIG. 12.

If there is a space for a vehicle ahead of the second line m2 before movement, a following vehicle is guided to the space, for example. For this reason, the guided vehicle may not be able to pass through the traffic light S simultaneously with or earlier than the vehicle X16.

On the other hand, if the space can be eliminated by moving the second line m2 forward, a vehicle traveling on the lane A cannot be guided to the lane B, for example. Thus, it is possible to prevent the above-mentioned unnecessary guidance.

Figure 13:
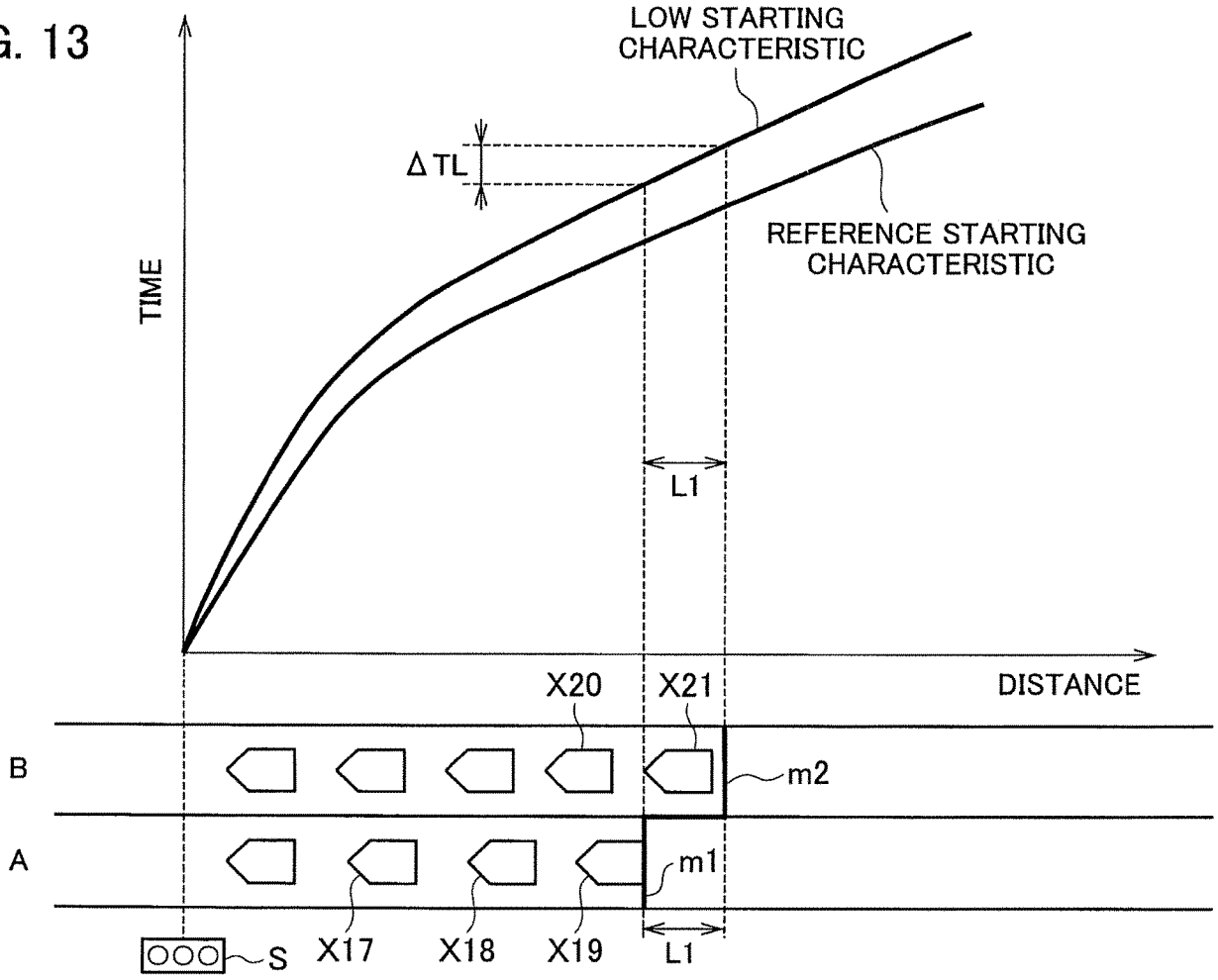
FIG. 13 is a diagram showing lines of vehicles in which vehicles having a low starting characteristic are included in the lanes A and B while a vehicle taking a left turn is included in the lane A, and showing an example of a calculated simultaneous passage line.

In FIG. 13, vehicles X17, X18, and X19 on the lane A are vehicles having the low starting characteristic and vehicles X20 and X21 on the lane B are also vehicles having the low starting characteristic. The vehicle X19 is about to take a left turn at the position of the traffic light S. Other vehicles are vehicles having the reference starting characteristic and are about to travel straight through the traffic light S.

A distance L1 [m] is a distance that a vehicle X19 having the low starting characteristic and taking a left turn travels in ΔTL [seconds] being the time required for the vehicle to take a left turn at the position of the traffic light S.

The position of the first line m1 is at the rear end of the vehicle X19 while the position of the second line m2 is located L1 [m] behind the first line m1.

If the vehicle X19 does not take a left turn, then the position of the second line m2 is at the rear end of the vehicle X21, because the vehicles having the low starting characteristic are included in the lanes A and B, and the vehicles on the respective lanes A and B start under the same condition.

Nonetheless, since the vehicle X19 takes a left turn, the position of the second line m2 is located L1 [m] behind the first line m1.

Figure 14:
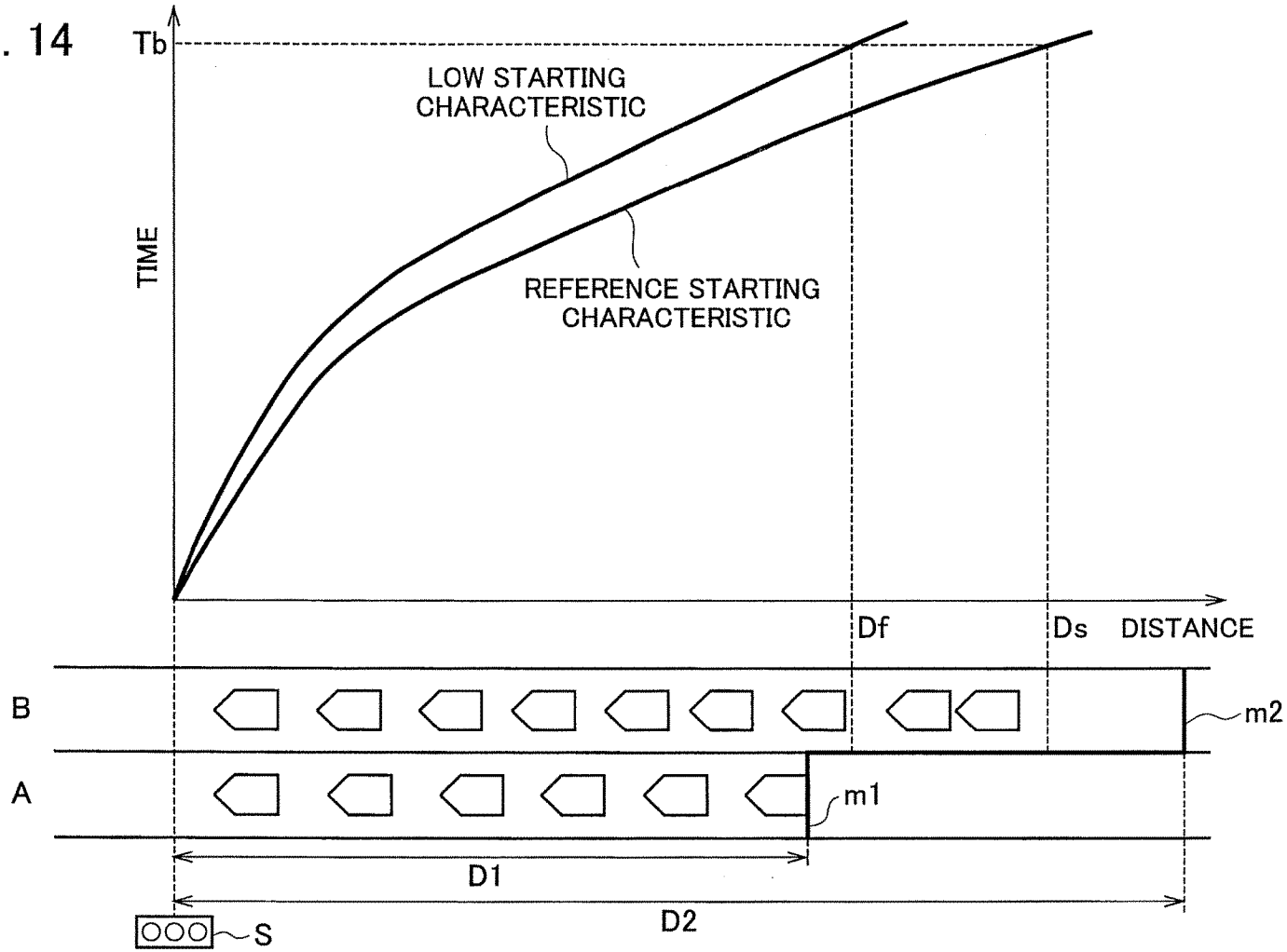
FIG. 14 is a diagram showing an example of lines of vehicles in a case where guidance of the vehicles is suspended.

As shown in FIG. 14, a length of time while the traffic light S holds on green is defined as Tb, a distance that a vehicle having the reference starting characteristic travels in the time Tb is defined as Ds, and a distance that a vehicle having the low starting characteristic travels in the time Tb is defined as Df.

In the meantime, a distance between the traffic light S and the first line m1 is defined as D1 and a distance between the traffic light S and the second line m2 is defined as D2.

In the case of FIG. 14, a condition Ds<D2 is satisfied while a condition Df<D1 is not satisfied. In other words, one of the conditions is satisfied and guidance of a following vehicle is therefore suspended.

Meanwhile, the guidance of the following vehicle is also suspended when the condition Df<D1 is satisfied while the condition Ds<D2 is not satisfied.

Moreover, the guidance of the following vehicle is also suspended when the condition Df<D1 is satisfied and the condition Ds<D2 is satisfied as well.

As described above, in one or more embodiments of the present invention, the guidance of the following vehicle is suspended when at least one of the condition Df<D1 and the condition Ds<D2 is satisfied. Thus, it is unnecessary to calculate the simultaneous passage lines or to guide the vehicles thereafter. Hence, it is possible to reduces loads associated with the calculation of the simultaneous passage lines, generation of signals required for guiding the vehicles, and so forth.

Although the vehicle guidance device 1 is provided separately from the vehicle in one or more embodiments of the present invention, the vehicle guidance device 1 may be incorporated in the vehicle instead. In this case, the vehicle information on other vehicles may be acquired by communication with those vehicles.

Moreover, in one or more embodiments of the present invention, the simultaneous passage line is calculated when the vehicle having the low starting characteristic is included in the first lane (A) while no vehicles having the low starting characteristic are included in the second lane (B).

However, the simultaneous passage line may be calculated when the vehicle having the low starting characteristic is included in the vehicles stopping on the first lane (A) and a vehicle (referred to as a relevant vehicle) having a starting characteristic higher than the starting characteristics of the vehicles on the first lane (A) is included in the vehicles stopping on the second lane (B).

This is because the starting characteristic of the relevant vehicle is higher than at least the starting characteristics of the vehicles on the first lane (A), and the positions of the first line and the second line are therefore different from each other.

Although embodiments of the present invention have been described above, it should be understood that the descriptions and the drawings constituting part of this disclosure are not intended to limit this invention. Various alternative embodiments, examples, and application techniques will be obvious to those skilled in the art from this disclosure. While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

REFERENCE SIGNS LIST

1 vehicle guidance device
2, X, X2, X3, X4, X5, X6, X7, X10, X11, X12, X13, X14, X15, X16, X17, X18, X19, X20, X21, Y vehicle
3 traffic control center
11 center information storage unit
12 vehicle information storage unit
13 map data storage unit
14 stopping vehicle detection unit
15 information acquisition unit
16 simultaneous passage line calculation unit
17 vehicle guidance unit
20 traveling condition record unit
21 acceleration sensor
22 steering
23 accelerator pedal
24 brake pedal
25 speedometer
26 GPS radio wave reception unit
27 direction indicator
28 communication unit
29 vehicle control unit
A lane (first lane)
B lane (second lane)
m1 first line
m2 second line
S traffic light

The invention claimed is:

1. A vehicle guidance device comprising:

a stopping vehicle detector configured to detect stopping vehicles failing to pass through a traffic light while a light is green, the traffic light being installed beside a plurality of lanes extending in a same direction;

an information acquisition unit configured to acquire a starting characteristic of each detected vehicle;

a simultaneous passage line calculator configured to calculate a simultaneous passage line including a first line and a second line based on the acquired starting characteristics, when a vehicle having a lower starting characteristic than a reference starting characteristic is included in the vehicles stopping on a first lane included in the plurality of lanes, and when a vehicle having a higher starting characteristic than starting characteristics of the vehicles on the first lane is included in the vehicles stopping on a second lane included in the plurality of lanes, the first line indicating a rear end of the vehicles on the tail on the first lane, and the second line indicating a rear end at a stop position of the vehicles on the second lane, which is predicted to pass through the traffic light simultaneously with the vehicle on the tail on the first lane; and a vehicle guidance unit configured to guide a vehicle following of the stopping vehicles to ahead of the simultaneous passage line.

2. The vehicle guidance device according to claim 1, wherein the simultaneous passage line calculator moves the second line backward when a vehicle taking any of a right turn and a left turn at a location of the traffic light is included in the vehicles stopping on the first lane.

3. The vehicle guidance device according to claim 1, wherein the information acquisition unit acquires a driving characteristic of a driver of each stopping vehicle, and wherein the simultaneous passage line calculator determines whether the driving characteristic corresponding to each vehicle stopping on the first lane is a low-speed driving characteristic or a high-speed driving characteristic, and moves the second line backward when the driving characteristic is determined as the low-speed driving characteristic.

4. The vehicle guidance device according to claim 1, wherein the information acquisition unit acquires a starting characteristic suitable for at least one of a weather and a period at the time of calculation of the simultaneous passage line, wherein the simultaneous passage line calculator calculates the simultaneous passage line based on the starting characteristic, and wherein the vehicle guidance unit guides the vehicle to ahead of the simultaneous passage line.

5. The vehicle guidance device according to claim 1, wherein, when a vehicle on the tail of a plurality of vehicles following one of the stopping vehicles becomes the vehicle on the tail on the first lane, the simultaneous passage line calculator determines a rear end of the vehicle on the tail as the first line and calculates the second line based on the first line.

6. The vehicle guidance device according to claim 1, wherein the information acquisition unit acquires a length of time the traffic light holds on green, and wherein the vehicle guidance unit suspends guidance of the following vehicle in a case of satisfaction of at least one of:

a condition that a distance which a vehicle starting with the reference starting characteristic travels in the length of time the traffic light holds on green is shorter than a distance between the traffic light and the second line, and a condition that a distance which a vehicle starting with the low starting characteristic travels in the length of time the traffic light holds on green is shorter than a distance between the traffic light and the first line.

7. The vehicle guidance device according to claim 1, wherein the information acquisition unit acquires vehicle type information on the vehicles from the vehicles, wherein the simultaneous passage line calculator calculates the simultaneous passage line based on the vehicle type information, and wherein the vehicle guidance unit guides the vehicle following the stopping vehicle to ahead of the simultaneous passage line calculated based on the vehicle type information.

8. A vehicle guidance method comprising:

detecting stopping vehicles failing to pass through a traffic light while a light is green, the traffic light being installed beside a plurality of lanes extending in a same direction;

acquiring a starting characteristic of each detected vehicle;

calculating a simultaneous passage line including a first line and a second line based on the acquired starting characteristics when a vehicle having a lower starting characteristic than a reference starting characteristic is included in the vehicles stopping on a first lane included in the plurality of lanes and when a vehicle having a higher starting characteristic than starting characteristics of the vehicles on the first lane is included in the vehicles stopping on a second lane included in the plurality of lanes, the first line indicating a rear end of the vehicles on the tail on the first lane, and the second line indicating a rear end at a stop position of the vehicles on the second lane, which is predicted to pass through the traffic light simultaneously with the vehicle on the tail on the first lane; and guiding a vehicle following the stopping vehicles to ahead of the simultaneous passage line.

* * * * *